US007037206B2

(12) United States Patent
Fliedner et al.

(10) Patent No.: US 7,037,206 B2
(45) Date of Patent: May 2, 2006

(54) BILLIARDS RACK

(76) Inventors: Jon Fliedner, P.O. Box 31, Farmingville, NY (US) 11738; Cornelius Cornell Fliedner, P.O. Box 31, Farmingville, NY (US) 11738; Daniel Cornell Fliedner, P.O. Box 31, Farmingville, NY (US) 11738

( * ) Notice: Subject to any disclaimer, the term of this patent is extended or adjusted under 35 U.S.C. 154(b) by 0 days.

(21) Appl. No.: 10/735,836

(22) Filed: Dec. 15, 2003

(65) Prior Publication Data

US 2005/0130754 A1 Jun. 16, 2005

(51) Int. Cl.
*A63D 15/00* (2006.01)

(52) U.S. Cl. ..... 473/40

(58) Field of Classification Search ..... 473/40, 473/41, 1, 21, 22, 26; 211/14; D21/782, D21/783, 316, 342, 385
See application file for complete search history.

(56) References Cited

U.S. PATENT DOCUMENTS

| | | | | |
|---|---|---|---|---|
| 228,879 | A | 6/1880 | De Gaetano | |
| 463,468 | A * | 11/1891 | Trumna | 273/115 |
| 526,554 | A * | 9/1894 | Barnes | 473/4 |
| 854,799 | A | 5/1907 | Callahan | |
| 1,106,991 | A * | 8/1914 | Thatcher | 273/261 |
| 1,457,464 | A * | 6/1923 | Sherrod | 473/1 |
| D91,422 | S * | 1/1934 | Fisher | D21/466 |
| 2,414,063 | A * | 1/1947 | Rogers | 446/247 |
| 3,014,723 | A * | 12/1961 | Butler | 273/350 |
| 3,115,340 | A * | 12/1963 | Stasiuk | 473/414 |
| 3,618,944 | A | 11/1971 | Myers | |
| 3,823,942 | A * | 7/1974 | Duncan | 473/514 |
| 3,825,258 | A | 7/1974 | Frierman | |
| 3,902,719 | A * | 9/1975 | Frierman | 473/41 |
| 4,005,861 | A | 2/1977 | Tomczak | |
| 4,183,523 | A * | 1/1980 | Hecht | 473/40 |
| 4,307,881 | A | 12/1981 | Jaworski | |
| 4,452,450 | A | 6/1984 | Cayton | |
| 4,619,455 | A | 10/1986 | Quraishi | |
| 4,620,631 | A * | 11/1986 | Bartelt | 206/217 |
| 4,768,781 | A | 9/1988 | McMillin | |
| 5,376,054 | A | 12/1994 | Kwasny et al. | |
| 5,775,570 | A * | 7/1998 | Kim | 229/4.5 |
| 5,800,273 | A | 9/1998 | Potocki | |
| 6,152,362 | A * | 11/2000 | Rosenfeld | 229/400 |
| 6,193,201 | B1 * | 2/2001 | Babcock | 248/311.2 |
| 6,261,187 | B1 | 7/2001 | Tsai | |
| 6,537,156 | B1 * | 3/2003 | Stagg | 473/40 |
| 6,612,485 | B1 * | 9/2003 | Lackner et al. | 229/400 |

FOREIGN PATENT DOCUMENTS

CA 2298246 A1 * 8/2001

* cited by examiner

*Primary Examiner*—Mitra Aryanpour
(74) *Attorney, Agent, or Firm*—Michael I. Kroll

(57) ABSTRACT

The present invention 10 discloses a billiards ball racking system comprised of two symmetrical circular loops 12, 14 bonded together. Each circular loop 12, 14 may hold up to seven billiard balls 16, six balls around the inner perimeter of each loop, and one ball 26 in the center. The present invention 10 may be composed of a plastic, metal or any rigid or semi-rigid substance or a flexible strap 32 for the proper functioning of the invention.

7 Claims, 12 Drawing Sheets

BILLIARDS RACK

BACKGROUND OF THE INVENTION

Field of the Invention

The present invention relates generally to billiard ball racking systems, more specifically, to a billiards rack comprised of two symmetrical circular loops bonded. Each circular loop may hold up to seven billiard balls, six balls around the inner perimeter of each loop, and one ball in the center. The invention may be composed of a plastic, metal or any rigid or semi ridged substance suitable for the proper functioning of the invention.

The new billiards rack provides four new pool games hereinafter described using the rack of the present invention. Traditionally and historically only two racks have been employed, a triangle and a diamond shape. The triangle rack has allowed "straight" pool, the diamond the game of 9 ball.

The rack of the present invention distributes the balls around the pool table in different configurations.

In Seven Ball, the balls are racked on one side of the present invention, (1,2 . . . 7) with the seven ball in the center when racked. Having only seven balls in the game, the game will proceed faster than games played using the triangle or diamond shaped racks. The cue ball must hit the lowest numbered ball on the table in turn until finally sinking the seven ball which ends the game.

In Conception Eight or Atom Smasher, the balls are racked on one side of the present invention, (2,3 . . . 8) with the eight ball in the center when racked with the one ball positioned outside. This gives the shape of a circle with one ball forward. The one ball can be placed in any outside location. The cue ball must hit the lowest numbered ball on the table in turn until finally sinking the eight ball which ends the game.

In Ball Buster, all balls are racked using both sides of the present invention with the fifteenth ball placed at the center of the two racks of seven balls. The balls may be separated 7 solid, 7 striped or mixed. Play would proceed as in traditional 8 ball.

In Fourteen Ball, both races contain 7 balls. Each ring would be placed parallel with the foot string.

2. Description of the Prior Art

There are other pool ball racks. Typical of these is U.S. Pat. No. 228,879 issued to Stephen De Gaetano on Jun. 15, 1880.

Another patent was issued to Thomas H. Callahan on May 28, 1907 as U.S. Pat. No. 854,799. Yet another U.S. Pat. No. 3,618,944 was issued to James H. Myers on Nov. 9, 1971 and still yet another was issued on Jul. 23, 1974 to E. Michael Frierman as U.S. Pat. No. 3,825,258.

Another patent was issued to Kenneth R. Tomczak on Feb. 1, 1977 as U.S. Pat. No. 4,005,861. Yet another U.S. Pat. No. 4,307,881 was issued to John W. Jaworski on Dec. 29, 1981 and still yet another was issued to William D. Clayton on Jun. 7, 1984 as U.S. Pat. No. 4,452,450

Another patent was issued to Azeez A. Quraishi on Oct. 28, 1986 as U.S. Pat. No. 4,619,455. Yet another U.S. Pat. No. 4,768,781 was issued on Sep. 6, 1988 to Roy E. McMillin and still yet another was issued on Dec. 27, 1994.

Another patent was issued Kwasny et al as U.S. Pat. No. 5,376,054. Yet another was issued to Potocki as U.S. Pat. No. 5,800,273 on Sep. 1, 1998 and still yet another was issued Tsai as U.S. Pat. No. 6,261,187 on Jul. 17, 2001.

U.S. Pat. No. 228,879

Inventor: Stephen de Gaetano

Issued: Jun. 15, 1880

A ball-frame or triangle composed of wood or other suitable material and formed with three interior and exterior curved or rounded corners, substantially as and for the purposes set forth.

U.S. Pat. No. 854,799

Inventor: Thomas H. Callahan

Issued: May. 28, 1907

A frame for pool balls, having the shape of a rhomboid.

U.S. Pat. No. 3,618,944

Inventor: James H. Myers

Issued: Nov. 9, 1971

A ball rack for use with pool or pocket billiard tables for locating the object balls in predetermined spread relation to one another on different areas of a pool table to facilitate locating the object balls for playing a new unique pool game. The rack has an elevated top wall provided with opening through which the balls are displaced downwardly onto the playing surface of the pool table and including resilient ring secured to the openings for engaging and accurately locating the balls on the pool table before removal of the rack therefrom.

U.S. Pat. No. 3,825,258

Inventor: E. Michael Frierman

Issued: Jul. 23, 1974

A floor-type billiard game is described wherein a rectangular playing surface has a length dimension range of from 8 to 12 feet, a width dimension range from 6 to 8 feet and a length to width ratio of less than 2. playing balls for the game are approximately the same size and composition as billiard balls. There are two oppositely-disposed, off-center side pockets which are closer to a spotting end of the playing surface than to a scratch-line end, and two side-by-side center end pockets at a scratch-line end of the of the playing surface. This pocket arrangement provides for a pocket density which compensates for the relatively large size playing surface. A spotting rack, which is used to rack balls at the end of the playing surface has a plurality of parallel compartments for racking the balls in separate parallel rows. The rack incorporates a device for transporting balls within the rack. A removable boundary is provided for dividing the normal playing surface into a smaller playing area. Rounded ball deflectors are positioned in boundary pockets breaks for deflecting balls driven into the breaks downwardly into pocket openings. A protective covering protects a seam between cushions and boundary frames. A game-mallet head is made of steel. At one end thereof, there is a flat striking surface at the other end thereof, there is a smaller 'tip' striking surface. The tip end has a resilient covering thereon. The flat end also has a covering to protect a cue ball from damage. The tip end also has a centered aiming edge which is used by players to align the striking tip with balls. A removable spin peg is mountable on the mallet head for use to impart additional spin to a truck cue ball.

U.S. Pat. No. 4,0050, 861

Inventor: Kenneth R. Tomczak

Issued: Feb. 1, 1977

Improved pocket-billiard trick shot racking device, whereby to facilitate making pocket-billiard trick shots, the racking device being a four-sided racking device having four walls and a trapezoidal shape in plan view so that it can rack six billiard balls at a time so that four thereof are disposed in the corners of said racking device each touching two walls of said device and the other two thereof are inside of the corner balls, the two innermost balls touching two of the corner balls and being spaced apart from each other so that the space between them is less than the diameter of the cue ball, the walls having inside dimensions of length precisely machined to one thousandth of an inch the walls having inside dimensions of length for any given diameter of billiard balls as follows: the front; rear; and side walls, respectively, being 3.717 diameters; 3.171 diameters; and 2.846 diameters.

U.S. Pat. No. 4,307,881

Inventor: John W. Jaworski

Issued: Dec. 29, 1981

A six ball pool rack is constructed having a frame defining two separate compartments. Each compartment is generally kidney-shaped and holds three pool balls in tangential relationship on a pool table. The compartments are joined by a center portion of the frame which separates the two groups of three balls and has indicator indicia imprinted thereon. The three balls are arranged in each compartment such that one of the balls is in contact with the center portions of the frame which separates the compartments.

U.S. Pat. No. 4,452,450

Inventor: William D. Clayton

Issued: Jun. 5, 1984

An improved pocket billiard rack configured to facilitate the circular arrangement of seven billiard balls on a billiard table. The rack includes a framing member having circular opening therethrough disposed between a top end and a bottom end. The framing member is dimensioned for receiving seven billiard balls in abutting relation positioned in a circular arrangement. The rack facilitates play in a novel "Seven Ball" billiard game, which permits players to perform combination and carom shots, defensive shots and placement in a fast-paced game.

U.S. Pat. No. 4,619,455

Inventor: Azeez A. Quraishi

Issued: Oct. 28, 1986

A game, using croquet-type balls corralled in an area of rebounder-type side rails, that can be assembled on any conventional rug or floor in which a taw ball is struck with a mallet to knock one's designated team balls, plus a "queen" ball, out of corral archway openings to gain points.

U.S. Pat. No. 4,768,781

Inventor: Roy E. McMillin

Issued: Sep. 6, 1988

A game device including a bordered playing field having a number of pockets formed in the field to receive target balls. The device includes a star-shaped rack having five spaced compartments, each of which receives and aligns a group of three target balls in a broken ring around a centrally positioned target ball. The shooter ball is positioned outside the ring and the game player uses a cue stick to strike and propel the shooter ball toward an appropriate target ball. The height of the playing field is adjustable and the playing field rotates to provide convenient access to elderly or handicapped players. The device is also conveniently disassembled for storage or shipping.

U.S. Pat. No. 5,376,054

Inventor: Charles D. Kwasny, et al

Issued: Dec. 27, 1994

A billiard ball rack for shaping a group of billiard balls on a pool table having leg members which when in a storage position enables the rack to be used as a standard triangular fifteen ball rack yet when moved to an alternate position such leg members in combination with other rack portions enables the rack to be alternately used as a diamond shape nine ball rack.

U.S. Pat. No. 5.8000.273

Inventor: John Potocki

Issued: Sep. 1, 1998

A kit for playing a pocket billiards game and method for playing a pocket billiards game utilizing seven object balls and a cue ball, the seven object balls comprised of three object balls having a first indicia, three object balls having a second indicia, and a single object ball having a third indicia, the overall object of the billiard game being for a player to pocket a billiard ball having a first or second indicia on one side of the table and thereafter pocket the remaining object balls having the same indicia on the same side of the table followed by the pocketing of the object ball having the third indicia on the same side of the table, the play alternating between a second player or a second team of players, the winning player or team being the one which first pockets the object ball having the third indicia on the players or teams designated side of the table.

U.S. Pat. No. 6,261,187

Inventor: Chin-Ho Tsai

Issued: Jul. 17, 2001

A rack includes three sides each having a protrusion on the first end thereof and a recess defined in the second end thereof so that the three sides are connected to be a triangle rack by engaging the three protrusions with the three recesses. Each side has two grooves defined in the inside thereof and two ridges extending from the outside thereof. Three separators each have two protrusions for being engaged with the corresponding grooves of the three sides to from a small triangle or a rhombus. Each separator has two concavities defined in the inside thereof so as to receive the ridges when attached to the outside of the sides.

While these billiard ball racking systems may be suitable for the purposes for which they were designed, they would not be as suitable for the purposes of the present invention, as hereinafter described.

SUMMARY OF THE PRESENT INVENTION

The present invention discloses a billiards ball racking system comprised of two symmetrical circular loops bonded together. Each circular loop may hold up to seven billiard balls, six balls around the inner perimeter of each loop, and one ball in the center. The present invention may be composed of a plastic, metal or any rigid or semi-rigid substance or a flexible strap for the proper functioning of the invention.

A primary object of the present invention is to provide and introduce four new pool games made possible by the invention.

Another object of the present invention is to provide a pool table rack that distributes the balls around the pool table in different configurations.

Yet another object of the present invention is to provide a new and novel way in which a game of pool can be played.

Still another object of the present invention is to provide a fantastic new way to play a game of pool using a different amount of pool balls.

Another object of the present invention is to provide a billiard game that is more competitive.

The present invention overcomes the shortcomings of the prior art by providing a billiard rack in which a number of different pool games can be played by the symmetrical circular construction of the instant invention.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
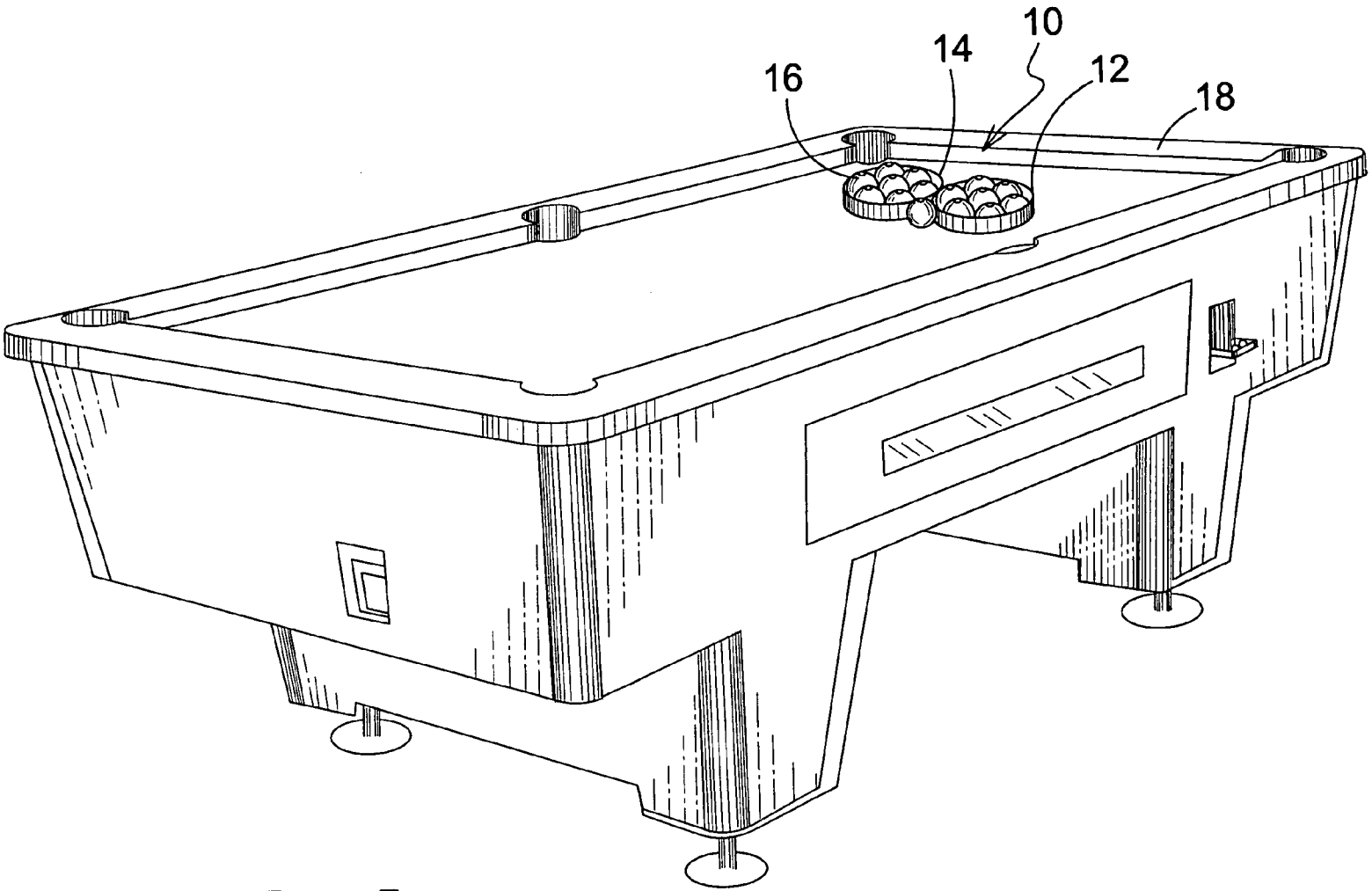
FIG. 1 is a perspective view of the billiards rack in use.

With regard to reference numerals used, the following numbering is used throughout the drawings.

10 present invention
12 rack loop
14 rack loop
16 billiard ball
18 billiards table
20 conjunction
22 outer surface
24 bonding agent
26 ball
28 foot string
30 head string
32 flexible strap assembly
34 plate
36 center line
38 foot spot

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10 in use on a billiards table 18. The present invention 10 is a billiards rack comprised of two symmetrical circular loops 12, 14 that are bonded together at the conjunction of the outer perimeter of the loops. Each circular loop 12, 14 may hold up to seven billiard balls 16, six balls around the inner perimeter of each loop and one ball in the center. The new billiards rack 10 provides means for playing new types of billiards games.

Figure 2:
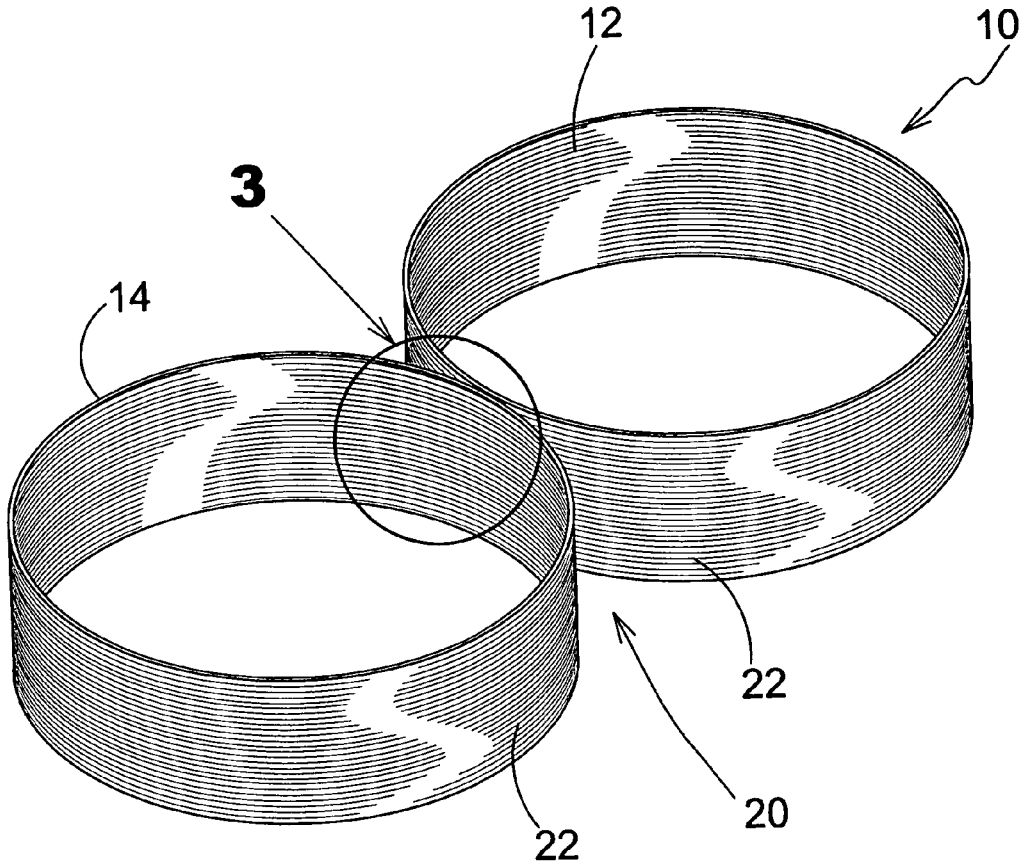
FIG. 2 is an isometric view of the billiards rack.

Turning to FIG. 2, shown therein is an isometric view of the billiards rack 10. The present invention is a billiards rack comprised of two symmetrical circular loops 12, 14 that are attached by a bonding agent at the conjunction 20 of the outer surface 22 or perimeters of the two loops.

Figure 3:
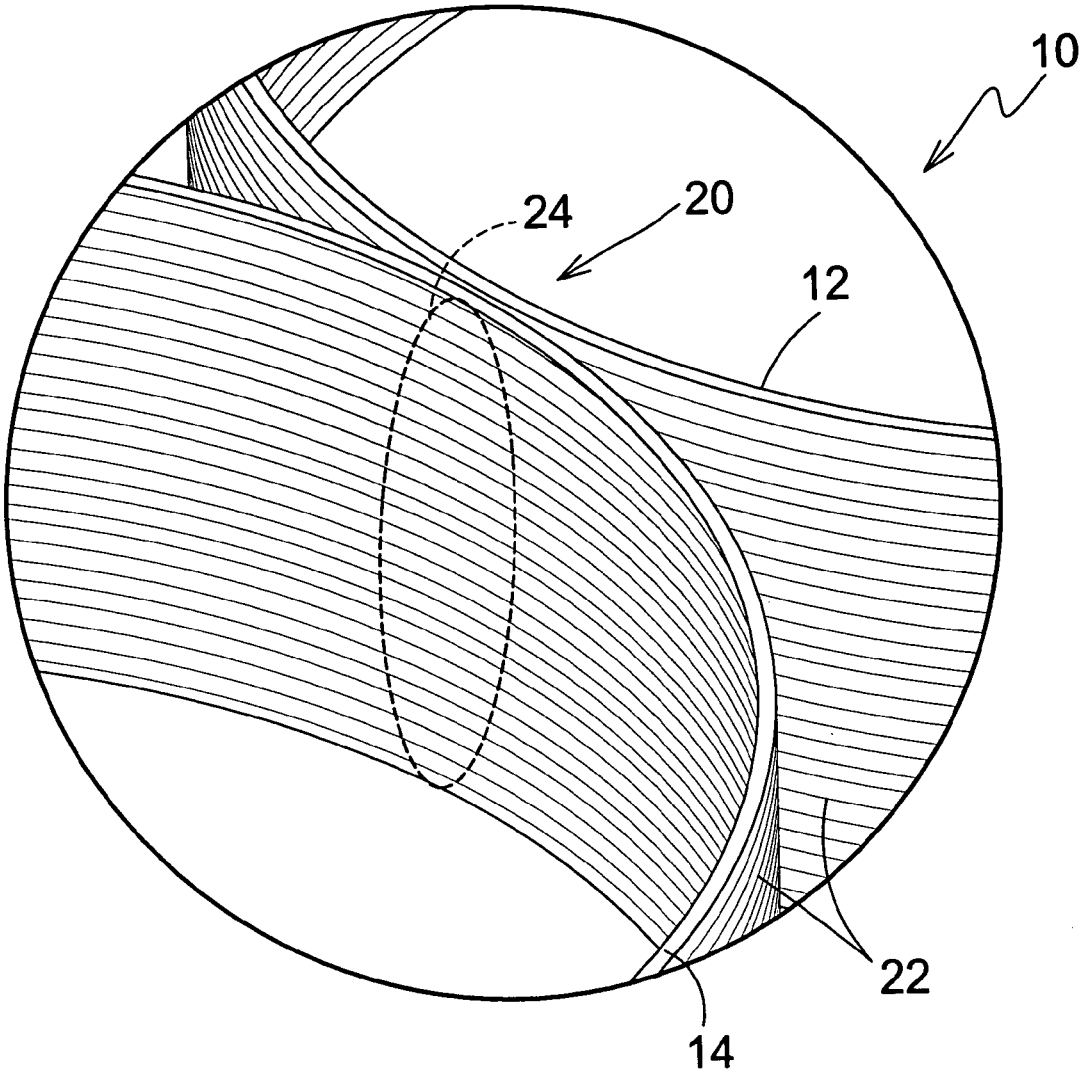
FIG. 3 is a detail view of the billiards rack.

Turning to FIG. 3, shown therein is a detail view of the billiards rack 10. Shown is the bonding agent 24 which resides at the conjunction 20 of the outer surface 22 of the two symmetrical circular loops 12, 14.

Figure 4:
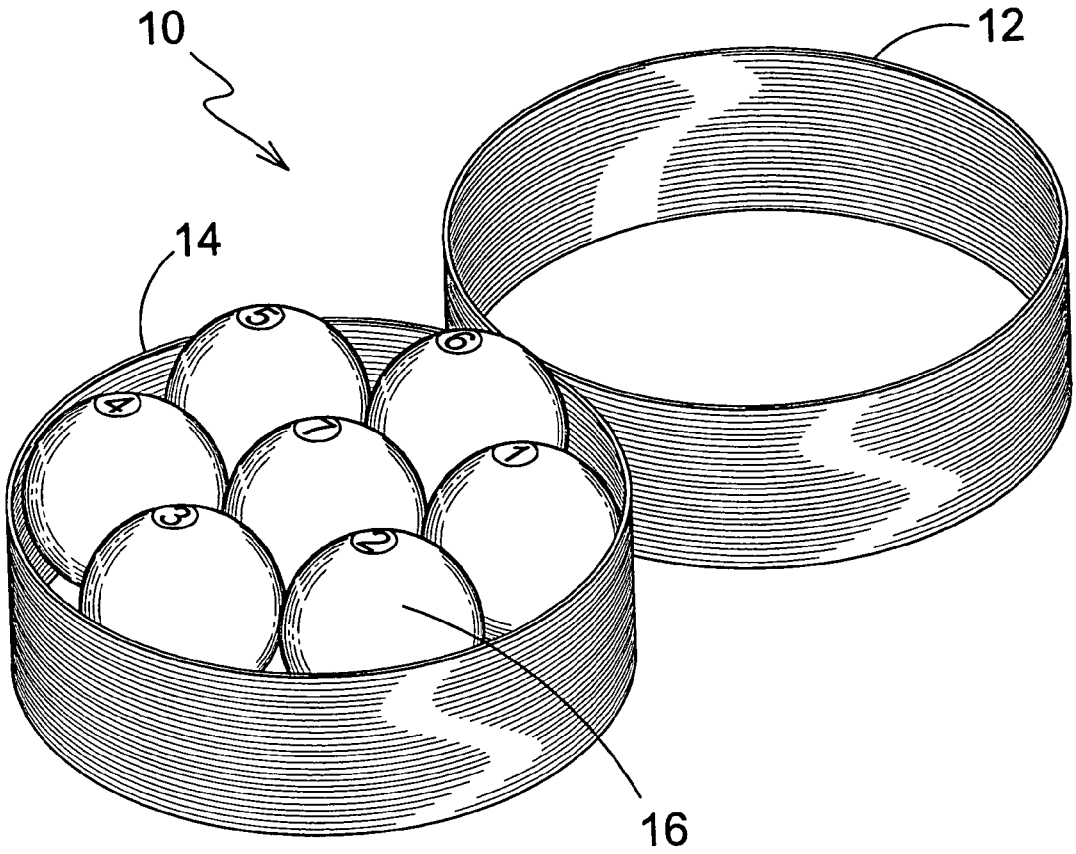
FIG. 4 is an isometric view of the billiards rack.

Turning to FIG. 4, shown therein is an isometric view of the billiards rack 10. Shown is the billiards rack 10 with six billiard balls 16 arranged in the inner perimeter of one of the circular loops 12, 14 and one ball in the center. Each loop 12, 14 has a capacity of arranging seven billiard balls 16 in any sequence that the user desires.

Figure 5:
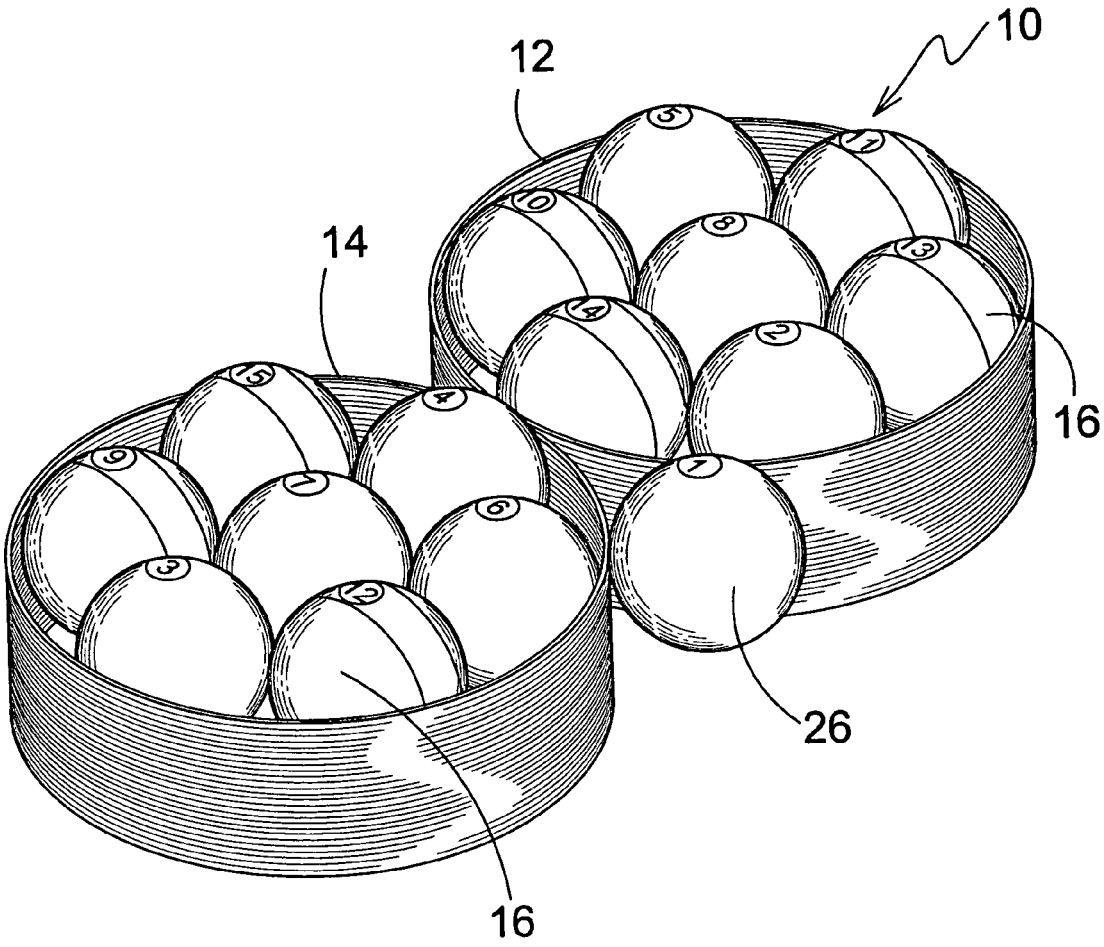
FIG. 5 is an isometric view of the billiards rack.

Turning to FIG. 5, shown therein is an isometric view of the billiards rack 10. Shown is the billiards rack 10 with six billiard balls 16 placed in the inner perimeter of each loop 12, 14 and one ball 26 in the center. One billiard ball 16 is placed flush against the outer perimeter of the loops 12, 14 near the conjoining area of the two loops.

Figure 6:
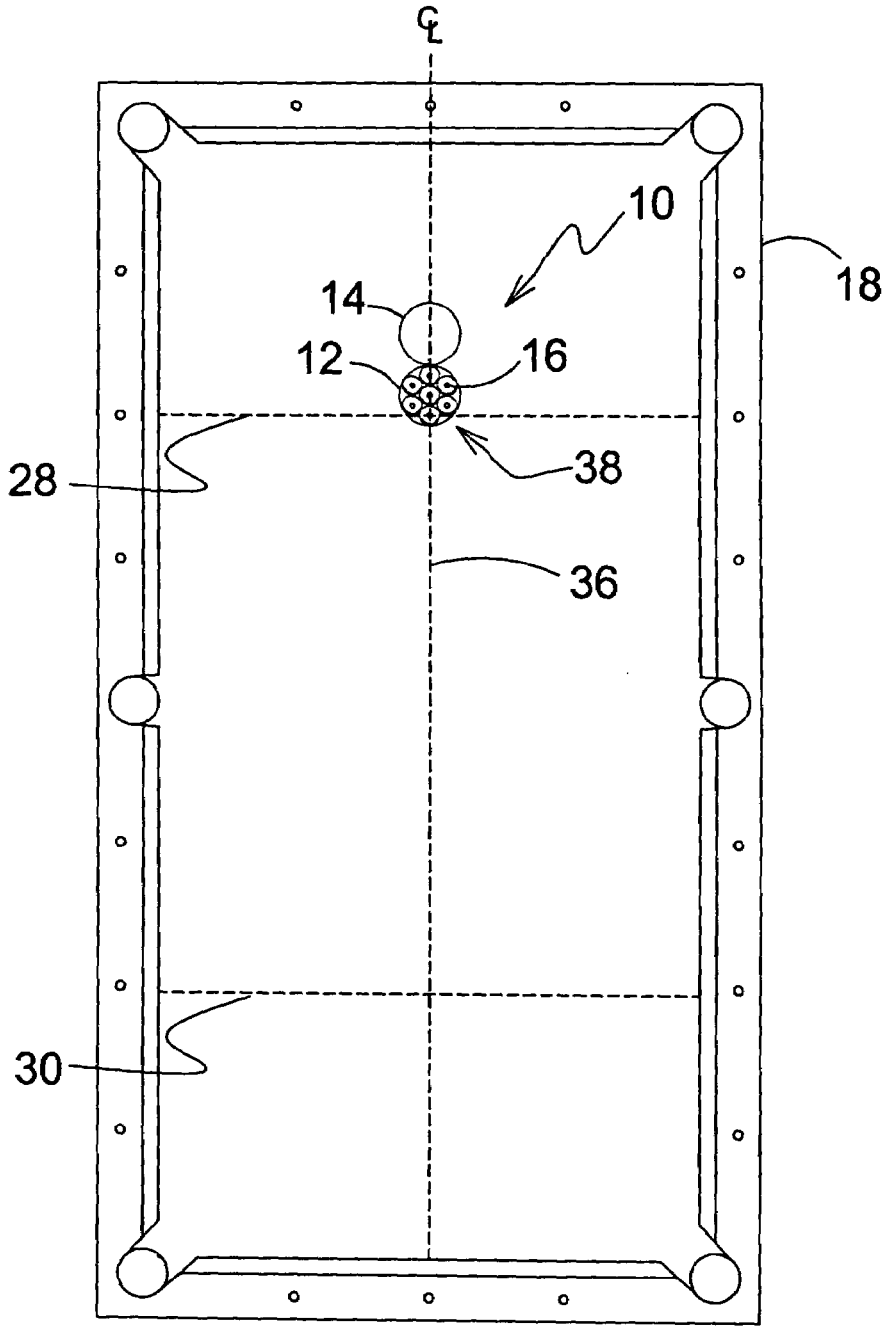
FIG. 6 is a top view of the billiards rack in use.

Turning to FIG. 6, shown therein is a top view of the billiards rack 10 in use. Depicted is a set of billiard balls 16 in one of the two circular loops 12, 14 consisting of six balls around the perimeter of the loop and one ball in the center. A typical table 18 alignment of the rack positions the center ball at the middle of the foot string or spot 28 on the table. In conventional billiard rules, the player would then break the balls with the cue ball starting from behind the head string 30. The table also has a centerline 36 and a foot spot 38 (not visible, see FIG. 10). The arrangement of balls is formed by placing one of the six balls disposed around the perimeter of the first loop of the billiards rack on the foot spot 38 of the billiards table 18 and removing the first loop from around the balls 16 to form an arrangement of seven balls so that the center ball 26 is also on the centerline 36 of the table.

Figure 7:
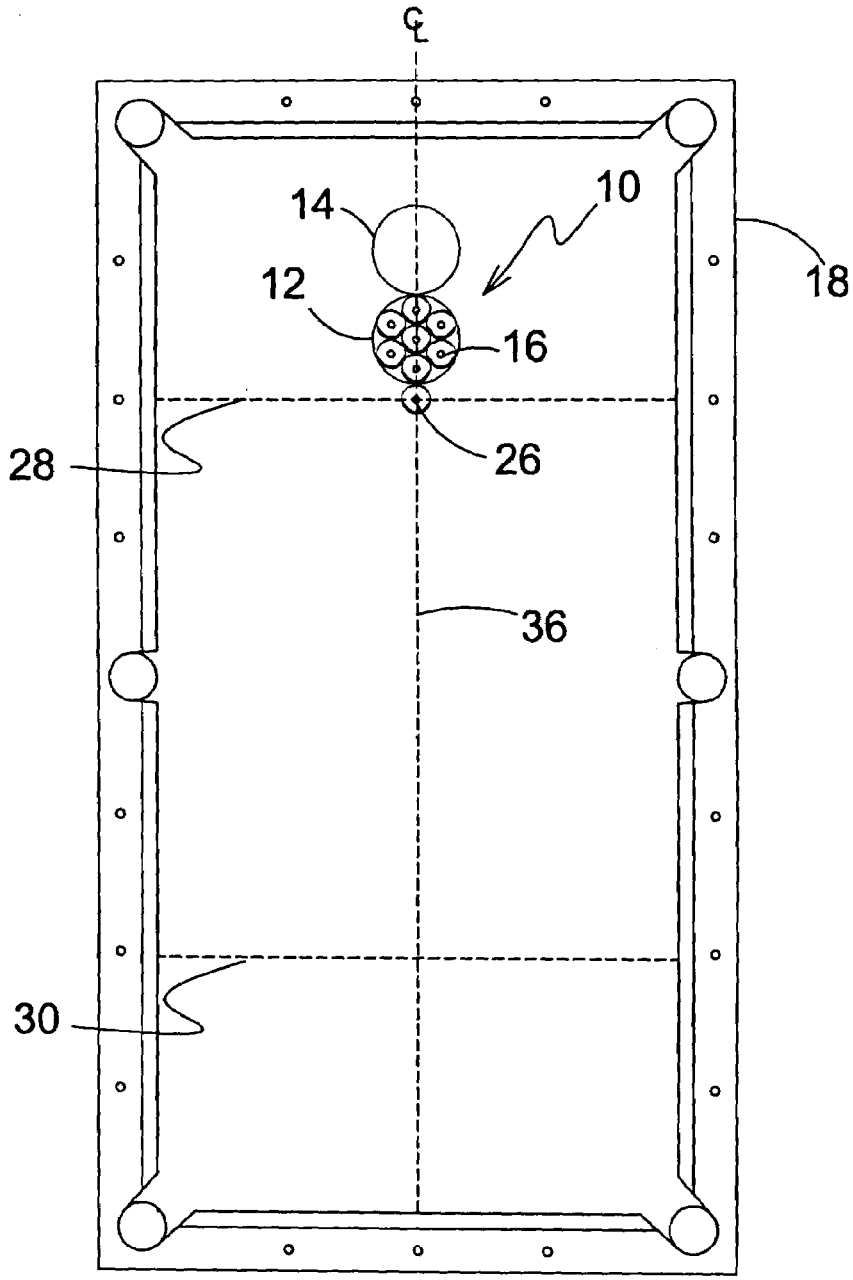
FIG. 7 is a top view of the billiards rack in use.

Turning to FIG. 7, shown therein is a top view of the billiards rack 10 in use. Depicted is a set of billiard balls 16 in one of the two circular loops 12, 14 consisting of six balls around the perimeter of the loop and one ball 26 on the foot spot. A typical table 18 alignment of the rack positions a ball 26 the center ball at the middle of the foot spot 28 on the table. In conventional billiard rules, the player would then break the balls 16 with the cue ball starting from behind the head string 30. The step of forming an arrangement of balls is accomplished by placing one of the six balls disposed around the perimeter of the first loop of the billiards rack on the center line of the billiards table directly behind the first billiards ball 26 so that the center ball is also on the center line of the billiards table.

Figure 8:
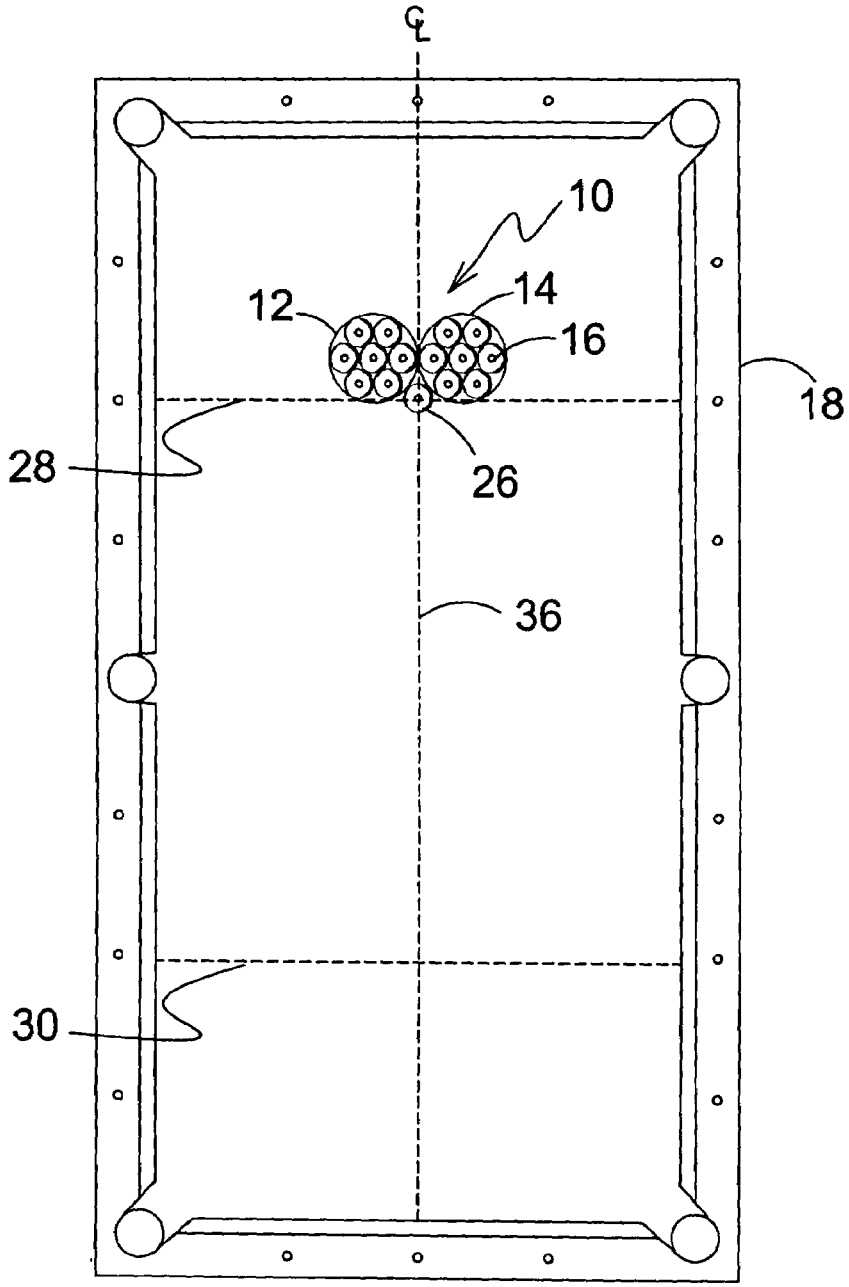
FIG. 8 is a top view of the billiards rack setup for traditional Eight Ball.

Turning to FIG. 8, shown therein is a top view of the billiards rack 10 setup for traditional Eight Ball. Depicted is a set of billiard balls 16 in both of the two circular loops 12, 14. Each loop 12, 14 consists of six balls 16 around the perimeter of the loop with one ball in the center and one 26 on the foot spot outside both loops. A possible table alignment positions the perimeter of the rack on the foot string 28 of the table 18. In conventional billiard rules, the player would then break the balls 16 with the cue ball starting from behind the head string 30. The step of forming an arrangement of balls is accomplished by placing the tangent point between the first and second loop on the center line 36 of the billiards table so that the edge of the first and second loop is on the foot string and the billiards balls are all located behind the foot string.

Figure 9:
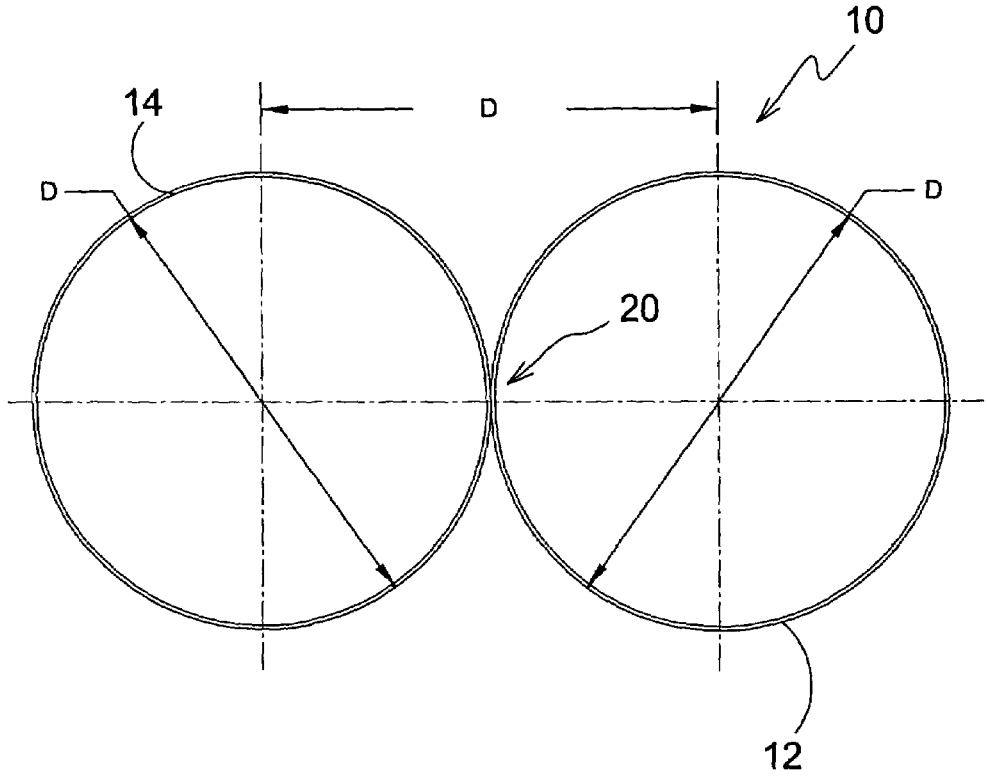
FIG. 9 is a top view of the billiards rack. The two circular loops are symmetrical.

Turning to FIG. 9, shown therein is a top view of the billiards rack 10. The two circular loops 12, 14 are symmetrical. Co-joined at one side 20, the on center dimension "D" is equal to the diameter of each loop 12, 14. This ensures a consistent rack. In addition, the symmetrical pattern allows the rack 10 to be flipped on the opposite side with no effect on the ball positions.

Figure 10:
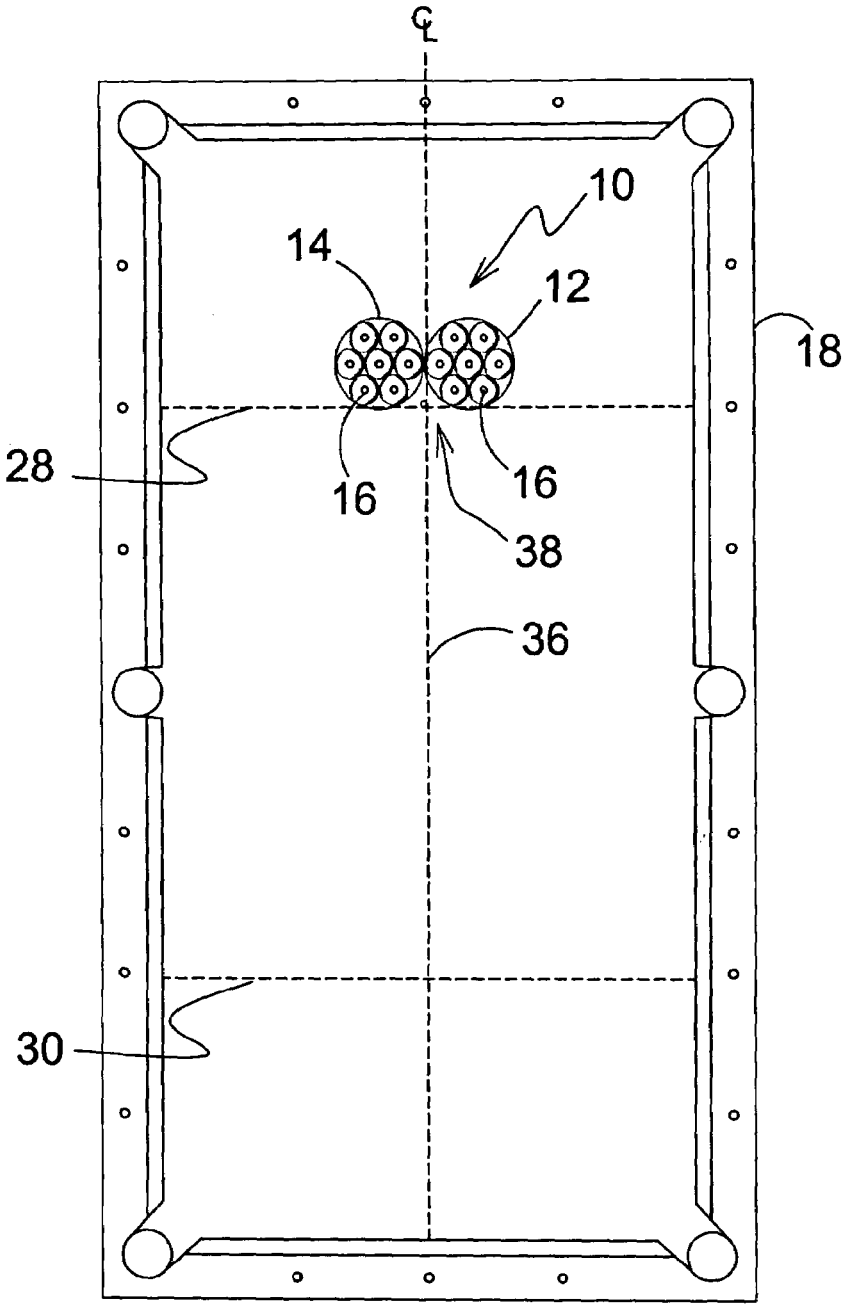
FIG. 10 is a top view of the billiards rack for Fourteen Ball.

Turning to FIG. 10, shown therein is a top view of the billiards rack 10 for Fourteen Ball. Depicted is a set of billiard balls 16 in both of the two circular loops 12, 14. Each loop 12, 14 consists of six balls 16 around the perimeter of the loop and one ball in the center. A possible table alignment positions the perimeter of the rack 10 on the foot string 28 of the table 18. Foot spot 38 is also shown. In conventional billiard rules, the player would then break the balls 16 with the cue ball starting from behind the head string 30. The step of forming an arrangement of balls is accomplished by placing the tangent point between the first and second loop on the center line 36 of the billiards table so that the edge of the first and second loop is on the foot string 28 and the billiards balls are all located behind the foot string.

Figure 11:
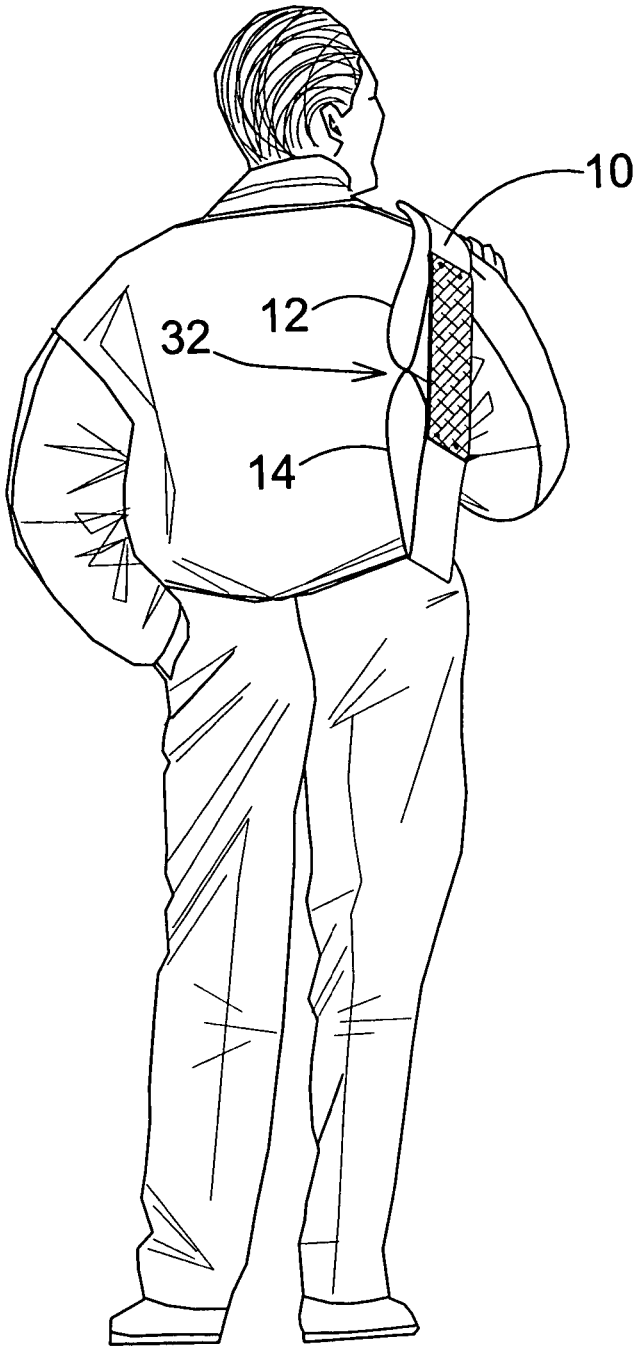
FIG. 11 is a perspective view of an alternate billiards rack.

Turning to FIG. 11, shown therein is a perspective view of an alternate billiards rack 10. Shown is an alternate billiards rack made of a flexible strap assembly 32 that when in use forms two symmetrical circular loops 12, 14. Each circular loop 12, 14 may hold up to seven billiard balls, six balls around the perimeter of each loop and one ball in the center.

Figure 12:
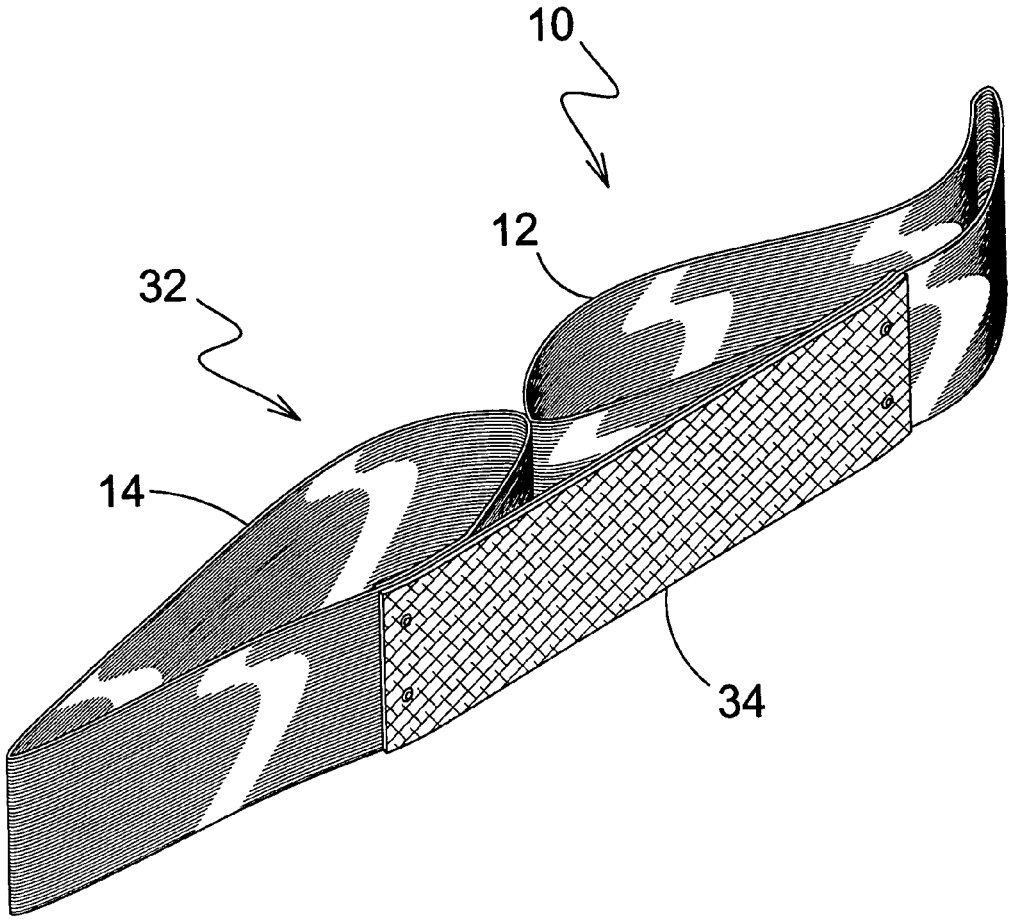
FIG. 12 is an isometric view of the alternate billiards rack.

Turning to FIG. 12, shown therein is an isometric view of the alternate billiards rack 10. The alternate billiards rack 10 is a flexible strap assembly 32. When not in use, the billiards rack 10 can be flexed and folded to provide easy storage and carrying. The flexible strap 32 is supported by a rigid plate 34 that ensures proper shaping of the circular loops 12, 14 when the billiard rack 10 is in use.

I claim:

1. A billiards rack in combination with a plurality of billiards balls and a pocket billiards table, the table having a foot string, a foot spot and a head string, the billiard rack comprising:

a) a first loop, said first loop having a first circular wall for receiving a plurality of billiards balls therein, said first wall having an inner and outer surface;

b) a second loop, said second loop having a second circular wall for receiving a plurality of billiards balls therein, said second wall having an inner and outer surface; and, c) wherein said outer surface of said first and second walls are directly joined together, the outer surface of said first wall being in direct contact with the outer surface of said second wall.

2. The billiards rack of claim 1, wherein said first and second loop are the same size.

3. The billiards rack of claim 1, wherein said first and second loop are each sized to receive seven billiards balls, wherein six balls are disposed around the perimeter of each loop and one ball is disposed in the center of each loop.

4. The billiards rack of claim 3, wherein said first and second loop are joined together with a bonding agent.

5. The billiards rack of claim 4, wherein said first and second loop are made of rigid material.

6. A billiards rack in combination with a plurality of billiards balls and a pocket billiards table, the table having a foot string, a foot spot and a head string, the billiard rack comprising:

a) a first loop, said first loop having a first circular wall of flexible material for receiving a plurality of billiards balls therein, said first wall having an inner and outer surface;

b) a second loop, said second loop having a second circular wall of flexible material for receiving a plurality of billiards balls therein, said second wall having an inner and outer surface; and, c) a rigid plate joining said first and second loops together, said rigid plate connecting a point on said outer surface tangent to each of said first and second loops wherein said rigid plate is parallel to a line connecting the centers of said first and second loops.

7. The billiards rack of claim 6 wherein said loops are collapsible for storage and portability.

* * * * *